US005540585A

United States Patent [19]

Coulcher, Jr. et al.

[11] Patent Number: 5,540,585

[45] Date of Patent: Jul. 30, 1996

[54] SELF-IGNITING HAND TORCHES

[75] Inventors: Richard D. Coulcher, Jr., Rochester; Michael L. Ridley, Holley, both of N.Y.

[73] Assignee: Newell Operating Company, Freeport, Ill.

[21] Appl. No.: 191,827

[22] Filed: Feb. 3, 1994

Related U.S. Application Data

[63] Continuation-in-part of Ser. No. 148,166, Nov. 4, 1993, Pat. No. 5,374,185, which is a continuation of Ser. No. 930,577, Aug. 14, 1992, abandoned.

[51] Int. Cl.[6] ..... F23Q 3/00

[52] U.S. Cl. ..... 431/264; 431/255; 431/258

[58] Field of Search ..... 431/255, 254, 431/258, 266, 265, 264, 344, 345, 354

[56] References Cited

U.S. PATENT DOCUMENTS

| | | | |
|---|---|---|---|
| 3,694,134 | 9/1972 | Ross . | |
| 3,984,738 | 10/1978 | Mohr . | |
| 4,113,423 | 9/1978 | Steiner . | |
| 4,325,356 | 4/1982 | Taschler . | |
| 4,348,172 | 9/1982 | Miller . | |
| 4,526,532 | 7/1985 | Nelson . | |
| 4,538,983 | 9/1985 | Zeller et al. . | |
| 4,666,399 | 5/1987 | Nelson . | |
| 4,691,136 | 9/1987 | Schmidt . | |
| 4,720,259 | 1/1988 | Day . | |
| 4,832,595 | 5/1989 | Eads . | |
| 4,881,894 | 11/1989 | Chapin et al. . | |
| 5,071,342 | 12/1991 | Yoshinaga | 431/255 X |
| 5,082,440 | 1/1992 | Yamamoto . | |
| 5,123,837 | 6/1992 | Farnham et al. | 431/258 |

FOREIGN PATENT DOCUMENTS

| | | | |
|---|---|---|---|
| 0272540 | 6/1988 | European Pat. Off. | 431/344 |
| 0415824 | 3/1991 | European Pat. Off. | 431/255 |
| 1753885 | 7/1976 | Germany . | |
| 0031221 | 2/1983 | Japan . | |
| 0031211 | 2/1983 | Japan . | |
| 0031224 | 2/1983 | Japan . | |

*Primary Examiner*—Carl D. Price

*Attorney, Agent, or Firm*—James G. Staples; Baker & McKenzie

[57] ABSTRACT

An economically improved self-igniting torch tip which provides for variable flame sizes through the selection and attachment of interchangeable burn tips and venturis. The torch tip also includes a conveniently located and durable built-in self-ignition system which is mounted in a heat resistant housing on the outside of the torch tip. The electrode and electrical connection for the electrode are disposed substantially outside of the burner tube so as to not interfere with the flow of combustible gases down through the tube.

14 Claims, 3 Drawing Sheets

SELF-IGNITING HAND TORCHES

This application is continuation-in-part of application Ser. No. 08/148,166, filed on Nov. 4, 1993 and now U.S. Pat. No. 5,374,185, which is a continuation of application Ser. No. 07/930,577, filed on Aug. 14, 1992, now abandoned.

FIELD OF THE INVENTION

This invention relates generally to hand torches employing a gas fuel such as acetylene, butane or propane. Specifically, the present invention relates to acetylene hand torches that are self-igniting. Even more particularly, the present invention relates to self-igniting air-acetylene hand torches which include an electrode configuration that does not interfere with the flow of combustible gases through the burner tube. Further, the present invention relates to self-igniting torches that enable the flame size to be adjusted by varying the internal geometries of the burn tips and the venturis.

BACKGROUND OF THE INVENTION

Gas torches are well known. Common fuels used for gas torches include acetylene, propane, butane and other lightweight hydrocarbon fuels. Industrial strength torches have commonly employed acetylene as a fuel and combined the gaseous acetylene with oxygen prior to ignition. This oxygen-acetylene system results in a very hot flame suitable for cutting thick metal. Other hydrocarbon fuels such as butane and propane are more suitable for lower temperature flames adequate for home use.

Recently, air-acetylene torches have been developed which produce a flame lower in temperature than oxygen-acetylene torches but do not require a separate pressurized canister for oxygen. Therefore, the air-acetylene torch systems are more portable than the oxygen-acetylene torch systems. Further, while air-acetylene torches produce a lower temperature flame than oxygen-acetylene torches, they produce a hotter flame than air-butane or air-propane torches. As a result, air-acetylene torch systems are popular with professionals because of their portability and because the flame is hotter than the flame provided by propane or butane.

Hand torches with built-in ignition systems are also known. Prior to the development of built-in ignition systems, the operator of the torch lit the torch with a separate sparking device such as a flint. The sparking device was held out in front of the burn tip after the gas was turned on. This method is not as safe as a built-in method because most built-in methods ignite the gas-air or gas-oxygen mixture inside the burner tube, away from the operator's hands.

Two types of self-ignition devices are currently available. One type offers an ignitor, such as a piezoelectric crystal mounted on the side of the burner tube with an electrode mounted inside the burner tube. A wire connecting the ignitor to the electrode extends down the inside of the burner tube joining the piezoelectric ignitor and the electrode.

This system is flawed because a bridge is required to mount the electrode between the side walls of the burner tube. The bridge and the electrode often interferes with the flow of the flammable fluid mixture in the burner tube thereby interfering with the formation of the flame. The turbulent flow caused by the placement of the bridge and the electrode in the path of the combustible gases can cause the gases to burn inside the tube which is unsafe. The potential for the combustible gases burning inside of the tube is especially great when the torch is operated at low pressures, i.e. 5 psi or less.

The other built-in ignition system currently available involves mounting the ignitor away from the burner tube toward the handle of the torch. A separate conduit is required that extends from the ignitor to the distal end of burner tube near the burn tip. While this system avoids the disadvantages of running a wire down the inside of the burner tube, it requires the separate conduit for the wire connecting the electrode to the ignitor and further requires a bulky mounting at the base of the torch to accommodate the ignitor. Torches known in the art of this type also teach the placement of the electrode in the path of the combustible gases thereby causing the turbulence problem discussed above.

Yet another problem associated with the prior art is the regulation of flame size. Currently, flame size is regulated in gas torches by changing the torch tips. By definition, a torch tip comprises a burn tip, a burner tube and a venturi. The burner tube connects the venturi to the burn tip. The venturi normally connects the torch tip to a handle or gas source. Most manufacturers offer torch tips in a variety of flame sizes and regulate the flame size by lengthening and shortening the burner tube. Short tubes of small diameters result in a smaller, narrower flame. Longer tubes of larger diameters result in a larger, broader flame.

Altering the burner tube size to alter flame size is not cost effective. Specifically, the burner tube is the largest element of a torch tip. By requiring a different burner tube for each different flame size, the kits offering a variety of torch tips for a variety of flame sizes are unnecessarily expensive due to the high cost of manufacture.

The present invention overcomes this problem by regulating the flame size independent of the burner tube size. Specifically, the burner tube size of the present invention remains consistent and the flame size is adjusted by changing the burner tips and the venturis, which are less expensive to manufacture, and consequently less expensive to modify, than the burner tubes.

BRIEF DESCRIPTION OF THE INVENTION

The present invention makes at least two significant contributions to the art of manufacturing hand torches. First, the present invention provides a superior built-in self-ignition system whereby the ignitor is placed along the burner tube for convenience and the wire connecting the electrode to the ignitor extends along the outside of the burner tube rather than the inside. The electrode is disposed at the outer periphery of the burner tube so it will not interfere with the flow of gas through the tube.

Second, the present invention provides a means for controlling the size of the flame by altering the burner tips and venturis, as opposed to altering the entire burner tube. Thus, torch tips made in accordance with the present invention are less expensive to manufacture and will last longer because the wire connections of the ignition systems are strategically placed along the outside of the burner tubes. Further, kits of torch tips offering different flame sizes will be less expensive to manufacture because torch tips of different flame sizes will all be made from the same size burner tube.

Specifically, a self-igniting torch tip is provided and is connected to a fuel source, such as acetylene or other suitable fuel. The torch tip includes a burner tube with a burn tip at the distal end and a venturi at the opposing or proximate end. The venturi preferably connects to a standard handle which is connected to the fuel source. The venturi consists of two parts, the venturi tube and the orifice. The venturi tube connects to the standard handle via a quick-connect connection and the orifice is disposed therebetween. The venturi is preferably detachably connected to the burner tube with a threaded connection.

The burner tube extends from the venturi to the burner tip. The burner tip is preferably detachably connected to the burner tube with a threaded connection. The burner tube serves as a support for the ignition system. Preferably, a piezoelectric ignitor is mounted on the outside of the burner tube. The piezoelectric ignitor provides a means for producing an electric potential. A wire connects the piezoelectric ignitor to an electrode. Thus, the electrode (or the means for producing a spark) is connected by a wire (or an electrical connection) to a piezoelectric ignitor (or a means for producing an electric potential). An opening is provided in the burner tube to accommodate the electrode. The electrode and the wire connecting the electrode to the ignitor are supported by an outer housing. A support base extends inwardly from an inside surface of the outer housing and mateably engages the opening in the burner tube. The electrode is mounted in the support base and a channel which accommodates the wire extends from the support base to the ignitor.

The support base is dimensioned so it mateably engages the opening in the burner tube and further so it does not extend appreciably past the inside surface of the burner tube. Accordingly, the support base does not interfere appreciably with the flow of combustible gases down the tube. Further, the electrode is long enough so its inside distal end is flush with the inner surface of the support base and therefore the inner distal end of the electrode does not extend appreciably into the burner tube where it would interfere with the flow of combustible gases.

When the piezoelectric ignitor is activated by pressing a button, an electrical signal is sent through the wire to the electrode where a spark is discharged. In the preferred embodiment, an air-acetylene fluid mixture travels through the burner tube and is ignited by the spark from the electrode.

The distal end of the electrode and the inside surface support base of the housing which supports the electrode and wire connection are flush with the inside surface of the burner tube and do not appreciably enter the burner tube through the opening. Thus, no bridge is required to suspend the electrode in the path of the air-fuel mixture. The electrode arrangement of the present invention does not interfere with the flow of the air-fuel mixture and consequently interfere less with flame formation than the bridge constructions taught by the prior art.

In the preferred embodiment of the present invention, the dimensions of the burner tube remain constant. Flame size is adjusted by changing the internal geometries of the burn tips and the venturis. At least two dimensions may be varied in the burn tips: the overall length of the burn tips and the minimum internal clearance. At least two dimensions may be varied in the venturis: the minimum internal clearance of the venturi tube, otherwise known as the through-hole, and the minimum internal clearance of the orifice.

For example, in order to obtain a ¼-inch flame with the preferred embodiment of the present invention, a burn tip that is about 1 ½ inches long with a minimum internal clearance of about ¼-inch is used in combination with a venturi orifice with a minimum clearance of about 0.01 inch with a venturi tube through-hole of about 1/10-inch. Further, in order to properly obtain a ⅜-inch flame with the preferred embodiment of the present invention, the burn tip should be about 1 ¼ inches long with a minimum internal clearance of about ⅓-inch. The venturi for a ⅜-inch flame should include about a 0.015 inch orifice (minimum internal clearance) with a venturi tube having about a ⅛-inch through hole (minimum internal clearance). Finally, to obtain a ½-inch flame with the preferred embodiment of the present invention, a burner tip having an overall length of about 1 ⅔ inches with a minimum internal clearance of about ½ inch should be used in combination with a venturi including an orifice with a minimum internal clearance of about 0.025 inch and a venturi tube through hole, or minimum internal clearance, of about ⅛ inches.

It is therefore an object of the present invention to provide a self-igniting hand torch with an improved ignition system configuration that is cheaper to manufacture and will last longer.

Yet another object of the present invention is to provide an improved electrode/wire/housing configuration for self-igniting torches which does not substantially interfere with the flow of gases through the burner tube.

It is another object of the present invention to provide an improved torch tip for hand torches whereby flame size may be adjusted by changing the dimensions of the burn tip.

It is yet another object of the present invention to provide an improved torch tip for hand torches whereby the flame size may be adjusted by changing the dimensions of the venturi.

It is yet another object of the present invention to provide a torch tip for hand torches with improved manufacturing economies and improved ignition system life.

BRIEF DESCRIPTION OF THE DRAWINGS

The invention is illustrated more or less diagrammatically in the accompanying drawings wherein.

Figures 1, 2, 3, 4, 5:
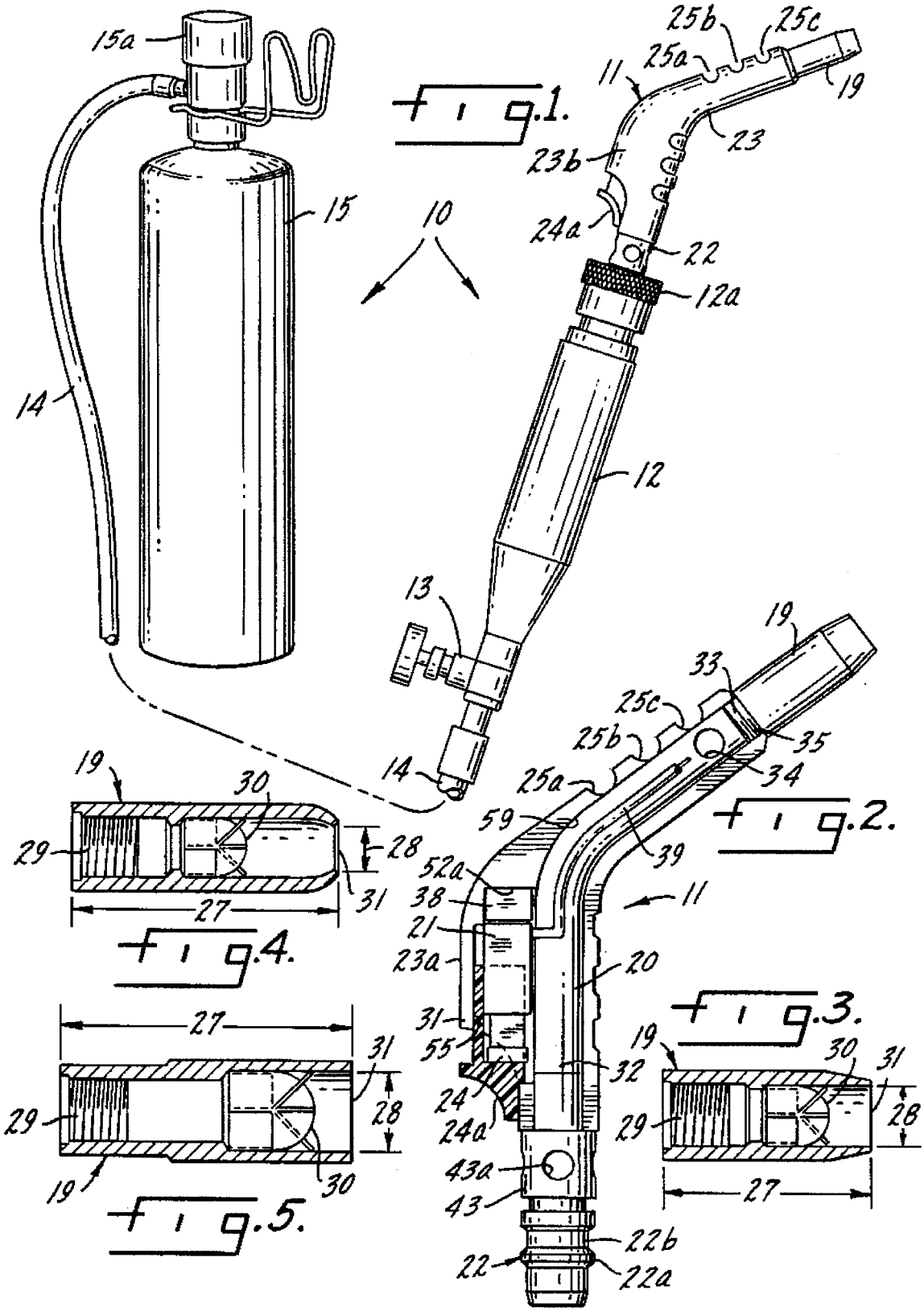
FIG. 1 is a perspective view of a complete flammable fluid torch system including a flammable fluid supply, a fluid supply hose, an industry-standard handle with an adjustable fluid supply valve, and a self-igniting torch tip made in accordance with the present invention.
FIG. 2 is a side sectional view of the self-igniting torch tip illustrated in FIG. 1 with parts in section.
FIG. 3 is an enlarged detailed view of a burn tip as illustrated in FIG. 2 having one length and one minimum internal clearance.
FIG. 4 is an enlarged detailed view of a burn tip as illustrated in FIG. 2 having an alternative length and an alternative minimum internal clearance.
FIG. 5 is also an enlarged detailed view of a burn tip as illustrated in FIG. 2 having yet another alternative length and yet another alternative minimum internal clearance.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE INVENTION

Like reference numerals will be used to refer to like or similar parts from Figure to Figure in the following description of the drawings.

A complete flammable fluid torch system made in accordance with the present invention is indicated generally at 10 in FIG. 1. The system includes a self-igniting torch tip 11, a handle 12, a flammable fluid regulator valve 13, a means for connecting the flammable fluid supply to a flammable fluid supply regulator 15*a*, and a flammable fluid supply 15. It will be understood that the fluid supply canister 15 is shown for illustration purposes only and is not drawn to scale and most supply canisters used with the present invention will be larger than the supply canister 15 shown in FIG. 1. During normal operation, the flammable fluid from the supply tank 15 passes through the connecting means 14 and reaches the flammable fluid regulator valve 13. Adjustment of this fluid regulator valve 13 provides for a constant flow of flammable fluid through the handle 12 to the self-igniting torch tip 11. Upon ignition by the torch tip 11, a steady flame is provided at the burn tip 19 (see also FIG. 2).

A quick-connect connection is provided by the coupling portion 12*a* disposed at the end of the handle 12. The inside surface of the coupling portion 12*a* (not shown) includes spring biased bearings that may be forcibly passed over the ring 22*a* of the venturi 22 (see FIG. 2). The bearings then lockingly engage the groove 22*b* to provide a mateable engagement between the venturi 22 and the coupling portion 12*a* of the standard handle 12.

FIG. 2 discloses an enlarged view of the self-igniting torch tip 11. The torch 11 comprises a burner tube 20, a burn tip 19 located at the distal end 33 (see also FIG. 6) of the burner tube 20, a venturi means 22 located at the proximate end 32 (see also FIG. 6) of the burner tube 20, an outer housing 23 affixed to the sides of the burner tube 20, and a piezoelectric ignitor 21 mounted within a lower end 31 of the outer housing 23. Each end 32, 33 of the burner tube 20 has complementary screw threads 35, 36 (see FIG. 6) which secure both the burn tip 19 and the venturi means 22 to the burner tube 20.

The outer housing 23 encases the exterior of the burner tube 20 and the piezoelectric ignitor 21. The outer housing 23 is made of a heat-resistant material. The slots 25*a*, 25*b*, 25*c* allow heat from the burner tube 20 to dissipate. Accordingly, the heat which is generated inside the burn tip 19 will not damage the outer housing 23 or the piezoelectric ignitor 21.

One end of the piezoelectric ignitor 21, which extends through the lower end of the outer housing 23, is attached to a push-button 24. The push-button 24 and the button actuator 24*a* are positioned in an aperture 55 in the outer housing 23 so as to provide easy operation for the hand torch user. The push-button 24 is spring biased so the ignitor 21 may be fired repeatedly. The channel 56 in the housing 23 accommodates the wire 39 which provides the electrical connection between the ignitor 21 (or means for generating an electric potential) and the electrode 67 (or means for producing a spark; see also FIG. 18). Alternative means for generating an electric potential 21 include electric ignition systems that will be apparent to those skilled in the art.

Referring to FIGS. 3, 4, and 5 together, the present invention employs interchangeable burn tips, indicated generally at 19. The burn tips 19 have complementary screw threads 29 which engage the distal end 33 of the burner tube 20 (see also FIG. 6). The flame holder vane assembly, indicated generally at 30, is disposed inside the outer opening 31 of the torch tip 19. Each burn tip 19 is distinguished by dimensions of length 27 and minimum internal clearance 28 and the flame size is adjusted by changing the burn tip length 27 and minimum internal clearance 28.

Figure 6:
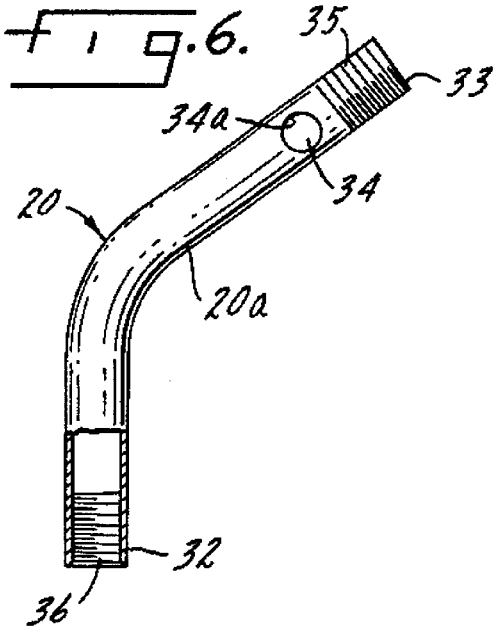
FIG. 6 is a side view of a burner tube as illustrated in FIG. 2.
Figure 18:
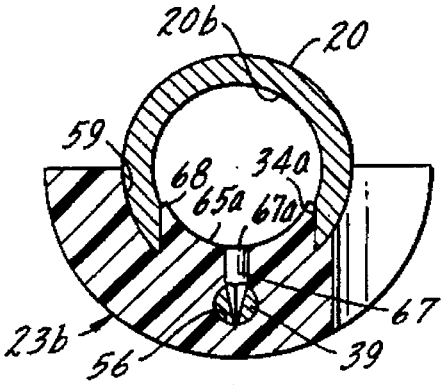
FIG. 18 is an enlarged detailed cross-sectional view taken substantially along line 17—17 of FIG. 15, illustrating the position of the burner tube and the means for producing a spark, or electrode.

FIG. 6 is a detailed view of the burner tube 20 which discloses an opening 34 which accommodates the electrode 67 (see FIG. 18). The opening 34 extends through one side of the outer surface 20*a* of the burner tube 20 and is located generally near the distal end 33 of burner tube 20 where the interchangeable burn tips 19 are attached. The proximate end 32 of the burner tube attaches to the venturi means 22. Both the burn tip 19 and the venturi means 22 are connected to the burner tube 20 by complementary screw threads 35, 29 and 36, 46 respectively.

Figure 7:
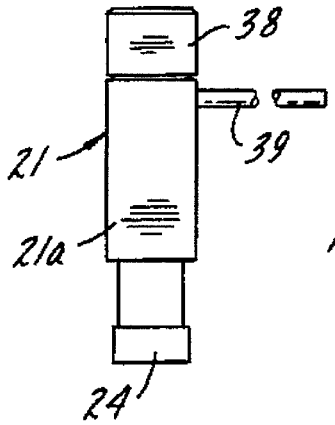
FIG. 7 is a side view of the means for generating an electric potential, or piezoelectric ignitor, shown in FIG. 2.
Figure 8:
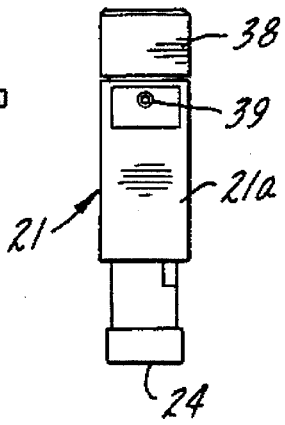
FIG. 8 is a top view of the means for generating an electric potential, or piezoelectric ignitor, shown in FIG. 7.
Figure 9:
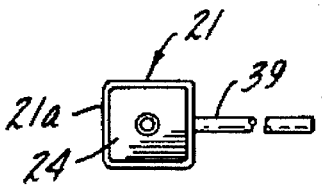
FIG. 9 is an end view of the means for generating an electric potential, or piezoelectric ignitor, shown in FIG. 7.

Another feature of this invention is the implementation of a piezoelectric ignitor 21 as illustrated in FIGS. 7, 8, and 9. Activation of the ignitor 21 requires the depression of the spring-biased push-button 24 which, as previously noted in FIG. 2, extends through the aperture 55 in the proximate end 31 of the outer housing 23. The electrical charge which is produced within the piezoelectric ignitor 21 is transmitted through the electrical connection 39. The push-button 24 and the electrical connection 39 are securely fastened to the piezoelectric ignitor 21 forming a wholly insulated assembly. An electrical charge is produced by the ignitor 21 as a result of a mechanical strain being imparted onto a piezoelectric crystal (not shown) contained within the housing 21*a*. The strain is imparted onto the crystal upon depression of the button actuator 24*a* (see FIG. 2) which is mounted on the button 24.

Figure 10:
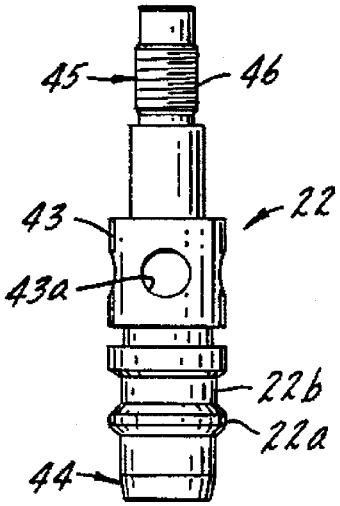
FIG. 10 is an elevational view of the venturi tube illustrated in FIG. 2.
Figure 12:
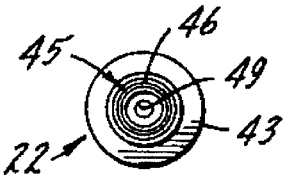
FIG. 12 is an end view of the venturi tube of FIG. 10, illustrating the tube's minimum internal clearance.
Figure 11:
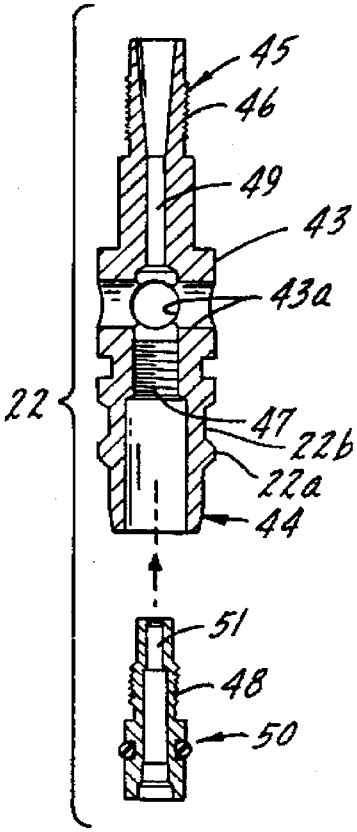
FIG. 11 is an exploded cross-sectional view of the venturi tube illustrated in FIG. 10, including a detailed cross-sectional view of the orifice.

Turning now to FIGS. 10 and 11, the present invention also includes a unique venturi means 22. The venturi means 22 consists of a venturi tube 43 and an orifice 50. The proximate end 44 of the venturi tube 43 can be attached to a standard handle assembly 12, and the distal end 45 of the venturi tube 43 can be secured to the proximate end 32 of burner tube 20 with the complementary screw threads 46. The distal end 45 of the venturi tube 43 as shown in FIG. 11 contains the venturi tube's minimum internal clearance 49 which is commonly referred to as a through-hole 49 (see also FIG. 12). The orifice 50 also has a minimum internal clearance 51 and is attached to the proximate end 44 of the venturi tube 43 using complementary screw threads 47, 48. Changes in the minimum internal clearance 49, 51 of both the venturi tube 43 and the orifice 50 also have a direct effect on flame size. The venturi 43 also includes an air introduction duct 43*a* for introducing air into the stream of flammable fluid directed down the burner tube 20 towards the burn tip 19. Thus, following the preferred procedure, a user can select a specific combination of burn tip 19 and venturi means 22 in order to produce a desired flame size.

Figure 13:
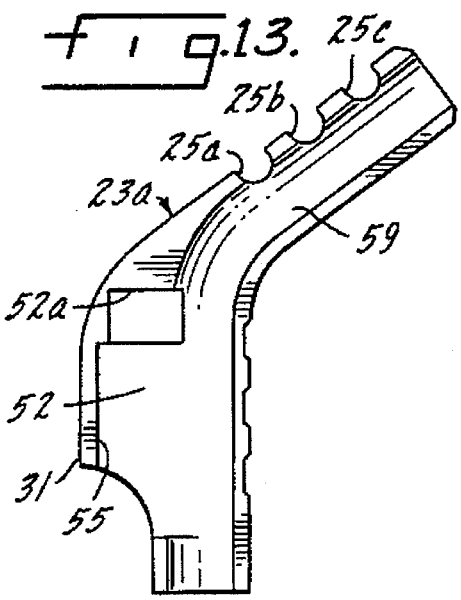
FIG. 13 is a right side view of the left half of the outer housing illustrated in FIG. 2.
Figure 15:
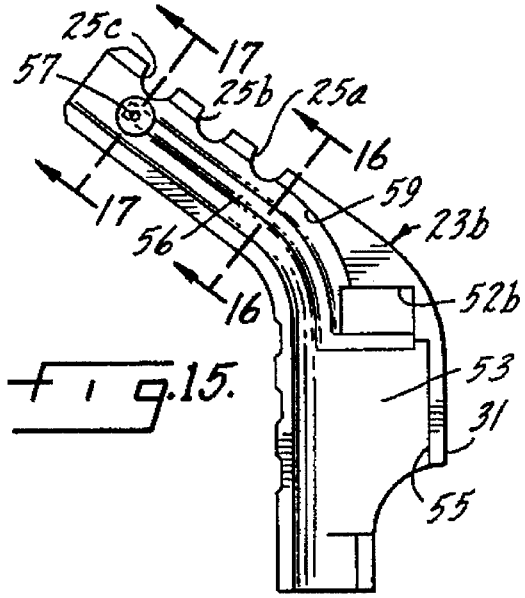
FIG. 15 is a left side view of the right half of the outer housing as illustrated in FIG. 2, showing the general placement of the electrical connection and the means for producing a spark, or electrode.

FIGS. 13 and 15 disclose the left 23*a* and right 23*b* halves of the outer housing 23, respectively. The slot 59 conforms to the exterior contour of and accommodates the burner tube 20. The aperture 55 at the proximate end 31 of the outer housing 23 provides access to the push-button 24 of the piezoelectric ignitor 21 and the button actuator 24*a*. FIG. 15 discloses a groove 56 which lines the internal wall of the right half of the outer housing 23 and serves to accommodate the electrical connection 39 (see FIGS. 2, 17 and 18) which extends from the piezoelectric ignitor 21 to the electrode 67 (see FIG. 18). The slot 56 may also be provided in the form of a channel imbedded in the housing 23*b* so that the wire would not abut or otherwise engage the outer surface 20*a* of the burner tube 20. For the purpose of securing the electrode 67, a hole 57 is provided in a support 65 which is disposed at the end of the groove 56 within the internal side of the right half 23*b* of the outer housing 23. The hole 57 may be positioned at approximately a 90° angle with respect to the axis of the burner tube 20 and is centered in the opening 34 of the burner tube 20. The support base 65 mateably engages the opening 34. The upper end 38 of the ignitor 21 is snugly received in the pockets 52*a*, 52*b* of the housing halves 23*a*, 23*b*. The slots 52, 53 provide further support for the ignitor 21.

Figure 14:
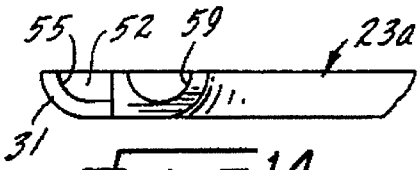
FIG. 14 is an end view of the left half of the outer housing as shown in FIG. 13.
Figure 16:
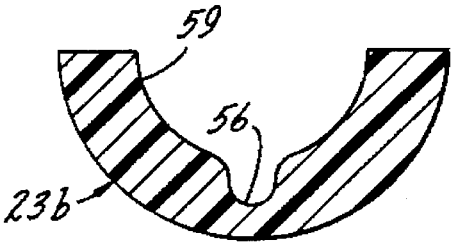
FIG. 16 is a view taken substantially along the line 16—16 of FIG. 15 showing an enlarged detailed cross-sectional view of the right half of the outer housing as shown in FIG. 15 which accommodates the electrical connection.
Figure 17:
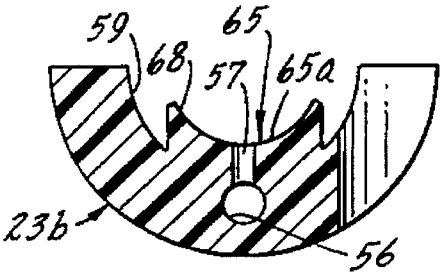
FIG. 17 is a view taken substantially along the line 17—17 of FIG. 15 showing an enlarged detailed cross-sectional view of the right half of the outer housing as shown in FIG. 15 which supports the means for producing a spark, or electrode.

FIG. 14 illustrates the proximate end 31 of the left case half 23*a* of the outer housing 23. FIGS. 16, 17 and 18 all disclose sections of the right half 23*b* of the outer housing 23. As seen in FIGS. 16–18, the groove 56 accommodates the electrical connection 39 and is disposed along the outer edge of the slot 59 that accommodates the burner tube 20.

As seen in FIG. 17, the hole 57 that supports the electrode 67 (see FIG. 18) terminates at the support base 65 which accommodates the electrode 67. The outer tab 68 of the support base 65 engages the outer periphery 34*a* of the opening 34 (see FIG. 6) of the burner tube 20. The inside surface 65*a* of the support base 65 is essentially flush with the inside surface 20*b* of the burner tube 20. Further, the inside distal end 67*a* of the electrode 67 is also flush with the inside surface 20*b* of the burner tube 20. Accordingly, neither the support base 65 nor the electrode 67 substantially interferes with the flow of combustible gases down through the burner tube 20. As noted above, interference with the flow of the combustible gases causes turbulence which can result in the ignition of gases upstream from the ignition 67 in the burner tube 20 which poses serious safety concerns. As seen in FIG. 18, the electrode 67 and support base 65 presents minimal obstruction of the flow of flammable fluid through the burner tube 20.

The use and operation of the invention is as follows.

A user of the self-igniting torch tip 11 will typically require a particular flame size for the work to be performed. Accordingly, the user may exercise his option of selecting a specific burn tip 19 and specific venturi means 22. For example, to obtain a ½-inch flame, the user would select a burn tip 19 having a length 27 of about 1 ⅔ inches and a minimum internal clearance 28 of about ½-inch, and the user would select a venturi tube 43 with a minimum internal clearance 49 of about ⅛-inch and an orifice 50 with a minimum internal clearance 51 of about 0.02 inches. The venturi means 22 is then secured to the proximate end 32 of the burner tube 20 while the burn tip 19 is secured to the distal end 33. Since the burner tube 20, outer housing 23, and piezoelectric ignitor 21 are provided as a one-piece construction, the self-igniting hand torch assembly is now complete and ready for operation.

Due to the economies of manufacture afforded by using the same burner tube 20 for different torch tips 11 of different flame sizes, the present invention will normally be practiced by employing several burner tubes 20 with preselected burner tip 19/venturi means 22 combinations already attached thereto. Accordingly, to change flame size, the user will change the entire torch tip 11 instead unscrewing individual burn tips 19 and/or venturi means 22 from the burner tubes. Further, because the burn tip 19 may get hot during use, it would be inconvenient, yet possible, for the user to remove a hot burn tip 19 from a burner tube 20.

The proximate end 44 of the venturi tube 43 may then be attached to an industry-standard handle assembly 12. The proximate end 44 the venturi tube 43 serves as a male portion of a duct coupling mechanism and the female portion of the duct coupling mechanism is provided by the coupling portion 12*a* disposed at the outlet of the handle 12. In use, the flammable fluid regulator or valve 13 is opened and combustible fluid from the source 15 is allowed to pass to the self-igniting torch tip 11. The fluid enters the hand torch through the venturi means 22 where it is mixed with air to produce a flowing combustible air-gas mixture. The gas then flows into the burner tube 20 and passes the electrode 67.

Depression of the push-button 24 activates the piezoelectric ignitor 21. The ignitor 21 produces a small electric charge which is then transmitted through the electrical connection 39 to the electrode 67. Subsequently, a small spark is produced at the tip of the electrode 67 at the inside surface 20*b* of the burner tube 20, and in the midst of the flowing combustible air-gas mixture.

The gaseous mixture is ignited and forms a steady flame at the outermost tip of the burn tip 19. Having selected the requisite burn tip 19 and venturi means 22, the user is provided with the desired flame size.

Further, as noted above, the placement of the ignitor 67 and supporting means 65 at the outer periphery or flush with the inside surface 20*b* of the burner tube eliminates the interference between the electrode 67 and the flow of combustible gases as taught by the prior art. The result is an effective ignition system that will not cause undo amounts of turbulence in the burner tube 20 which may result in combustion upstream in the burner tube.

As noted above, the flame size may be adjusted by varying the venturi means 22 and/or the burn tip 19 without altering the dimensions of the burner tube 20. One or more dimensions of the burn tip 19 and venturi means 22 may be altered to change flame size. Examples of burn tip 19 and venturi means 22 combinations for ¼, ⅜ and ½ inch flame sizes are presented below as approximations for comparison purposes:

| Flame size, in. | ¼ | ⅜ | ½ |
|---|---|---|---|
| Burn tip length 27 in. (approx.) | 1½ | 1¼ | 1⅔ |
| Burn tip clearance 28 in. (approx.) | ¼ | ⅓ | ½ |
| Through-hole clearance 49 in. (approx.) | 1/10 | ⅛ | ⅛ |
| Orifice clearance 51 In. (approx.) | 0.01 | 0.015 | 0.025 |

Although a single preferred embodiment of the present invention has been illustrated and described (and relatively few variations of the burner tips and venturi means), it will at once be apparent to those skilled in the art that other variations may be made within the spirit and scope of the invention. Accordingly, it is intended that the scope of the invention be limited solely by the scope of the hereafter appended claims and not by the specific wording in the foregoing description.

We claim:

1. An improved torch tip for self-igniting torches, the torch tip comprising:

a venturi, a burner tube, a burn tip, an ignitor, the venturi introducing air through an air introduction duct into a stream of flammable fluid directed through the burner tube, the burner tube including a proximate end and a distal end, the proximate end of the burner tube attaching to the venturi, the distal end of the burner tube attaching to a burn tip, the burner tube including an opening for accommodating an electrode, the opening being disposed adjacent to the distal end of the burner tube, the opening extending between and an outside surface of the burner tube and an inside surface of the burner tube, the ignitor including a means for generating an electric potential and an electrical connection between the means for generating an electric potential and the electrode, the means for generating an electrical potential and the electrical connection being disposed outside of the burner tube, the electrode being contained within a support base of an outer housing disposed on the outside surface of the burner tube, the support base of the outer housing also mateably enclosing the opening in the burner tube, the support base extending through the opening in the burner tube and terminating at an inside surface of the support base which is flush with the inside surface of the burner tube, the electrode terminating at the inside surface of the support base.

2. The torch tip of claim 1, wherein the outer housing is further characterized as including two opposing outer halves, each outer half including a first slot to accommodate the burner tube and a second slot to accommodate the means for generating an electric potential, the two opposing outer halves abuttingly engaging each other around the burner tube to form an aperture to provide access to the means for generating an electric potential.

3. The torch tip of claim 2, wherein one half of the outer housing includes a third slot to accommodate the electrical connection between the electrode and the means for generating an electric potential.

4. The torch tip of claim 3, wherein said one half of the outer housing further includes the support base and a fourth slot disposed in the support base for accommodating the electrode.

5. The torch tip of claim 4, wherein the fourth slot is disposed in the support base at substantially a right angle to an axis of the burner tube, the electrode being disposed in the support base and in the opening of the burner tube at substantially a right angle to the axis of the burner tube.

6. A self-igniting torch tip for connection to a handle in communication with a flammable fluid source, the handle including fluid regulation means for controlling the flow rate of flammable fluid through the handle, the torch tip emitting a flame of a predetermined size, the torch tip comprising:

a male connector for connecting to a female connector of a duct coupling mechanism disposed on a fluid outlet duct disposed on the handle, a venturi, a burner tube, a burn tip, an ignitor, the burner tube having a proximate end and a distal end, the proximate end being connected to the venturi, the distal end being connected to the burn tip, the burner tube also including an opening for accommodating a means for producing a spark, the opening extending from an outside surface of the burner tube to an inside surface of the burner tube, the opening for accommodating the means for producing a spark, the opening being disposed adjacent to the burn tip, the venturi for introducing air through an air introduction duct into a flow of flammable fluid directed from the flammable fluid source through the burn tip, the venturi includes a venturi tube and an orifice, the venturi tube includes a proximate end and a distal end, the proximate end of the venturi tube accommodating an orifice, the distal end of the venturi tube being attached to the proximate end of the burner tube, the proximate end of the venturi tube including the male connector for connection with the female connector of the duct coupling mechanism disposed between the torch tip and the handle, the orifice being disposed between the venturi tube and the duct coupling mechanism, the venturi tube having a minimum internal clearance, the orifice having a minimum internal clearance, the venturi being removable from the burner tube and replaceable with an alternative venturi having alternative venturi tubes and orifices of different minimum internal clearances for modifying flame size, the burn tip having a length and a minimum internal clearance, the flame size being a function of the minimum internal clearances of the burn tip, the venturi tube and the orifice, the burn tip being removable and replaceable with alternative burn tips of different lengths and different minimum internal clearances for modifying flame size, the ignitor for igniting a flammable fluid-air mixture in the burner tube assembly near the burn tip, the ignitor including the means for producing a spark, a means for generating an electric potential and an electrical connection between the means for generating an electric potential and the means for producing a spark, the means for generating an electric potential and the electrical connection being accommodated in an outer housing mounted on the outside surface of the burner tube between the proximate and distal ends thereof, the outer housing being characterized as including two opposing outer halves, each outer half including a first slot to accommodate the burner tube, a second slot to accommodate the means for generating an electric potential and an aperture to provide access to the means for generating an electric potential, one opposing outer half of the outer housing including an inwardly extending support base that encloses the opening in the burner tube and accommodates the means for generating a spark, an inside surface of the support base is flush with the inside surface of the burner tube, the means for generating a spark being supported within the support base and terminating at the inside surface of the support base.

7. The torch tip of claim 6, wherein the one opposing half of the outer housing includes a third slot to accommodate the electrical connection between the means for generating the electric potential and the means for generating a spark.

8. The torch tip of claim 7, wherein the means for generating a spark is disposed in said support base at substantially a right angle to an axis of the burner tube.

9. An improved torch tip comprising:

a burner tube including a proximate end and a distal end, the proximate end of the burner tube attaching to a venturi, the distal end of the burner tube attaching to a burn tip, the burner tube including an opening for accommodating a means for generating a spark, the opening being disposed adjacent to the distal end of the burner tube, an ignitor, the ignitor including the means for generating a spark, a means for generating an electric potential and an electrical connection between the means for generating an electric potential and the means for generating a spark, the means for generating an electrical potential and the electrical connection being disposed outside of the burner tube and between the proximate and distal ends thereof, the means for generating an electrical potential, the electrical connection and the burner tube are substantially contained within an outer housing carried by the outer surface of the burner tube between the proximate and distal ends thereof, the outer housing also mateably enclosing the opening in the burner tube for accommodating the means for generating a spark, the outer housing being characterized as including two opposing outer halves and a push-button cover that mateably engages the means for generating an electric potential and that protects the means for generating an electric potential from dirt and moisture, each outer half including a first slot to accommodate the burner tube, a second slot to accommodate the means for generating an electric potential, a third slot for accommodating a portion of the electrical connection and an aperture for accommodating the push-button cover.

10. A torch tip for a flammable fluid torch system, the torch tip comprising:

a venturi including a venturi tube and an orifice, the orifice being tubular in configuration and being accommodated within a proximate end of the venturi tube, the venturi introducing air through an air introduction duct passing through a wall of the venturi tube from an outside surface thereof, the orifice extending between the proximate end of the venturi tube and the air introduction duct, a stream of flammable fluid flowing through the orifice before it mixes with the air supplied through the air introduction duct, a burner tube, the burner tube including a proximate end and a distal end, the proximate end of the burner tube attaching to the distal end of the venturi tube, the distal end of the burner tube attaching to a burn tip, the burner tube including an opening through which a means for generating a spark extends, an ignitor, the ignitor including the means for generating a spark, a means for generating an electric potential and an electrical connection between the means for generating an electric potential and the means for generating a spark, the means for generating an electrical potential and the electrical connection being disposed on an outside surface of the burner tube between the proximate and distal ends thereof, the means for generating an electrical potential, the electrical connection-and the proximate end of the burner tube are substantially contained within an outer housing carried by the outer surface of the burner tube between the proximate and distal ends thereof, the outer housing also enclosing the opening in the burner tube through which the means for generating a spark extends, the outer housing being characterized as including two opposing outer halves and a push-button cover that mateably engages the means for generating an electric potential and that protects the means for generating an electric potential from dirt and moisture, each outer half including a first slot to accommodate the burner tube, a second slot to accommodate the means for generating an electric potential, a third slot for accommodating a portion of the electrical connection and an aperture for accommodating the push-button cover.

11. A self-igniting torch tip comprising:

a venturi, a burner tube, a burn tip, an ignitor, the burner tube having a proximate end and a distal end, the proximate end connecting to the venturi, the distal end connecting to the burn tip, the burner tube also including an opening through which a means for producing a spark extends, the venturi for introducing air through an air introduction duct into a flow of flammable fluid directed through the venturi toward the burner tube, the venturi including a venturi tube and an orifice, the venturi tube includes a proximate end and a distal end, the orifice being tubular in configuration and being accommodated in the venturi tube between the proximate end of the venturi tube an air introduction duct that extends through an outside wall of the venturi tube, the distal end of the venturi tube being attached to the proximate end of the burner tube, the ignitor for igniting a flammable fluid-air mixture in the burner tube, the ignitor including the means for producing a spark, a means for generating an electric potential and an electrical connection between the means for generating an electric potential and the means for producing a spark, the means for generating an electric potential being accommodated in an outer housing mounted on an outside surface of the burner tube between the proximate and distal ends thereof, the outer housing also enclosing the opening in the burner tube through which the means for generating a spark extends, the outer housing being characterized as including two opposing outer halves and a push-button cover that mateably engages the means for generating an electric potential and that protects the means for generating an electric potential from dirt and moisture, each outer half including a first slot to accommodate the burner tube, a second slot to accommodate the means for generating an electric potential, a third slot for accommodating a portion of the electrical connection and an aperture for accommodating the push-button cover.

12. A self-igniting torch tip for connection to a handle in communication with a flammable fluid source, the handle including fluid regulation means for controlling the flow rate of flammable fluid through the handle, the torch tip comprising:

a male connector for connecting to a female connector of a duct coupling mechanism disposed on a fluid outlet duct disposed on the handle, a venturi, a burner tube, a burn tip, an ignitor, the burner tube having a proximate end and a distal end, the proximate end connecting to the venturi, the distal end connecting to the burn tip, the burner tube also including an opening for accommodating a means for producing a spark, the opening extending from an outside surface of the burner tube to an inside surface of the burner tube, the opening for accommodating the means for producing a spark, the venturi for introducing air through an air introduction duct into a flow of flammable fluid directed from the flammable fluid source through the burn tip, the venturi include a proximate end and a distal end, the proximate end of the venturi tube including the male connector for connection with the female connector of the duct coupling mechanism disposed between the torch tip and the handle, the ignitor for igniting a flammable fluid-air mixture in the burner tube, the ignitor including the means for producing a spark, a means for generating an electric potential and an electrical connection between the means for generating an electric potential and the means for producing a spark, the means for generating an electric potential being accommodated in an outer housing mounted on the outside surface of the burner tube between the proximate and distal ends thereof, the outer housing being characterized as including two opposing outer halves and a push-button cover that mateably engages the means for generating an electric potential and that protects the means for generating an electric potential from dirt and moisture, each outer half including a first slot to accommodate the burner tube, a second slot to accommodate the means for generating an electric potential, a third slot for accommodating a portion of the electrical connection and an aperture for accommodating the push-button cover.

13. An improved torch tip comprising:

a burner tube including a proximate end and a distal end, the proximate end of the burner tube attaching to a venturi, the distal end of the burner tube attaching to a burn tip, the burner tube including an opening for accommodating a means for generating a spark, an ignitor, the ignitor including the means for generating a spark, a means for generating an electric potential and an electrical connection between the means for generating an electric potential and the means for generating a spark, the means for generating an electrical potential being disposed outside of the burner tube and between the proximate and distal ends thereof, the means for generating an electrical potential and the burner tube are substantially contained within an outer housing carried by the outer surface of the burner tube between the proximate and distal ends thereof, the outer housing also mateably enclosing the opening in the burner tube for accommodating the means for generating a spark, the outer housing being characterized as including two opposing outer halves and a push-button cover that mateably engages the means for generating an electric potential and that protects the means for generating an electric potential from dirt and moisture, each outer half including a first slot to accommodate the burner tube, a second slot to accommodate the means for generating an electric potential, a third slot for accommodating a portion of the electrical connection and an aperture for accommodating the push-button cover.

14. A self-igniting torch tip comprising:

a burner tube disposed between a venturi and a burn tip, the burner tube including an opening for accommodating a means for generating a spark, an ignitor, the ignitor including the means for generating a spark, a means for generating an electric potential and an electrical connection between the means for generating an electric potential and the means for generating a spark, the means for generating an electrical potential, a portion of the electrical connection and a portion of the burner tube being contained within an outer housing carried by an outer surface of the burner tube, the outer housing including two opposing halves and a push-button cover that mateably engages over the means for generating an electric potential and that protects the means for generating an electric potential from dirt and moisture, each opposing half including a first slot for accommodating the burner tube, a second slot for accommodating the means for generating an electric potential and a third slot for accommodating a portion of the electrical connection and the opening in the burner tube, the two opposing halves also forming an aperture to accommodate the push-button cover.

* * * * *